US009745827B2

(12) United States Patent
Allen et al.

(10) Patent No.: US 9,745,827 B2
(45) Date of Patent: Aug. 29, 2017

(54) COMPLETION ASSEMBLY WITH BYPASS FOR REVERSING VALVE

(71) Applicants: Jason A. Allen, Houston, TX (US); Robert S. O'Brien, Katy, TX (US); Aaron C. Hammer, Houston, TX (US); Andrew James Cayson, Cypress, TX (US)

(72) Inventors: Jason A. Allen, Houston, TX (US); Robert S. O'Brien, Katy, TX (US); Aaron C. Hammer, Houston, TX (US); Andrew James Cayson, Cypress, TX (US)

(73) Assignee: BAKER HUGHES INCORPORATED, Houston, TX (US)

( * ) Notice: Subject to any disclaimer, the term of this patent is extended or adjusted under 35 U.S.C. 154(b) by 306 days.

(21) Appl. No.: 14/590,636

(22) Filed: Jan. 6, 2015

(65) Prior Publication Data

US 2016/0194936 A1 Jul. 7, 2016

(51) Int. Cl.

| | |
|---|---|
| ***E21B 34/12*** | (2006.01) |
| ***E21B 33/124*** | (2006.01) |
| *E21B 34/00* | (2006.01) |

(52) U.S. Cl.

CPC ..... *E21B 34/12* (2013.01); *E21B 33/124* (2013.01); *E21B 2034/007* (2013.01)

(58) Field of Classification Search

CPC .. E21B 34/12; E21B 33/124; E21B 2034/007; E21B 43/04; E21B 43/08

See application file for complete search history.

(56) References Cited

U.S. PATENT DOCUMENTS

| | | | |
|---|---|---|---|
| 2,257,344 | A | 9/1941 | Maloney |
| 2,565,742 | A | 8/1951 | Sailers |

(Continued)

FOREIGN PATENT DOCUMENTS

| | | | |
|---|---|---|---|
| GB | 2382828 | A | 6/2003 |
| WO | 2011028560 | A2 | 3/2011 |
| WO | 2011028563 | A3 | 3/2011 |

OTHER PUBLICATIONS

PCT International Search Report and Written Opinion; International Application No. PCT/US2014/050334; International Filing Date: Aug. 8, 2014; Date of Mailing: Nov. 27, 2014; pp. 1-11.

(Continued)

*Primary Examiner* — Yong Suk (Philip) Ro

(74) *Attorney, Agent, or Firm* — Cantor Colburn LLP

(57) ABSTRACT

An apparatus for use in a wellbore includes an outer assembly and inner assembly. The outer assembly includes a set down profile, a first flow device for supplying a fluid to a zone in the wellbore and a second flow device for providing a flow path from the formation to inside of the outer assembly. The inner assembly includes a frac port for supplying a fluid from the inner assembly to the first flow device, a valve below the frac port that remains closed when a fluid at a selected flow rate flows downward from above the valve, and a bypass device uphole of the valve. The bypass device opens when the inner assembly is set down in the set down profile and provides a flow path from below the frac port to an annulus between the inner assembly and the outer assembly above the frac port.

21 Claims, 3 Drawing Sheets

(56) References Cited

U.S. PATENT DOCUMENTS

| | | | |
|---|---|---|---|
| 2,629,444 | A | 2/1953 | O'Donnell |
| 3,302,722 | A | 2/1967 | Madely, Sr. |
| 3,831,632 | A | 8/1974 | Young |
| 4,128,105 | A | 12/1978 | Follett |
| 4,428,428 | A | 1/1984 | Smyrl et al. |
| 4,700,776 | A | 10/1987 | Petrovic |
| 5,829,523 | A | 11/1998 | North |
| 5,890,540 | A | 4/1999 | Pia et al. |
| 6,382,319 | B1 | 5/2002 | Hill, Jr. et al. |
| 6,446,729 | B1 | 9/2002 | Bixenman et al. |
| 6,464,006 | B2 | 10/2002 | Womble |
| 6,568,472 | B1 | 5/2003 | Gano et al. |
| 6,789,623 | B2 | 9/2004 | Hill, Jr. et al. |
| 7,090,020 | B2 | 8/2006 | Hill et al. |
| 7,331,388 | B2 | 2/2008 | Vilela et al. |
| 7,357,198 | B2 | 4/2008 | McGarian et al. |
| 7,543,647 | B2 | 6/2009 | Walker |
| 7,950,454 | B2 * | 5/2011 | Patel ..... E21B 43/045 166/278 |
| 8,272,445 | B2 | 9/2012 | Fay |
| 8,596,368 | B2 | 12/2013 | Frosell |
| 8,770,292 | B2 | 7/2014 | McClung, III |
| 8,978,775 | B2 | 3/2015 | Lindsay et al. |
| 9,267,345 | B2 | 2/2016 | Grande et al. |
| 2004/0140089 | A1 | 7/2004 | Gunneroed |
| 2005/0082060 | A1 | 4/2005 | Ward et al. |
| 2005/0156131 | A1 | 7/2005 | Holliday |
| 2007/0068675 | A1 | 3/2007 | Barry et al. |
| 2008/0099194 | A1 | 5/2008 | Clem |
| 2008/0314591 | A1 | 12/2008 | Hales et al. |
| 2009/0294177 | A1 | 12/2009 | Chan et al. |
| 2010/0200245 | A1 | 8/2010 | Ringgenberg et al. |
| 2011/0056686 | A1 | 3/2011 | Clem |
| 2011/0067886 | A1 | 3/2011 | Moen |
| 2011/0209919 | A1 | 9/2011 | Aros |
| 2012/0085548 | A1 | 4/2012 | Fleckenstein et al. |
| 2012/0097397 | A1 | 4/2012 | Hofman et al. |
| 2012/0103608 | A1 | 5/2012 | Van Petegem et al. |
| 2012/0118579 | A1 | 5/2012 | Murray et al. |
| 2012/0261131 | A1 | 10/2012 | Hofman et al. |
| 2014/0246206 | A1 | 9/2014 | Least et al. |

OTHER PUBLICATIONS

PCT International Search Report and Written Opinion; International Application No. PCT/US2015/057995; International Filing Date: Oct. 29, 2015; Date of Mailing: Jan. 25, 2016; pp. 1-14.

* cited by examiner

COMPLETION ASSEMBLY WITH BYPASS FOR REVERSING VALVE

BACKGROUND

1. Field of the Disclosure

This disclosure relates generally to apparatus and methods for treating wellbores, including pressure testing and fracturing and sand packing production zones and the production of hydrocarbons from such zones.

2. Background of the Art

Wellbores or wells are drilled in subsurface formations for the production of hydrocarbons (oil and gas) trapped in zones at different depths. Treatment operations, such as fracturing and sand packing, water flooding ad gravel packing, are often performed to complete the wells. In multi-zone wells, a completion assembly that includes completion and production equipment corresponding to each zone is placed in such wellbores. A service assembly placed inside the completion assembly is used to manipulate various devices in the completion assembly to treat each zone. Pressure tests are performed on each zone before treating such zones to obtain information about the formation and detect fluid leaks after isolation of such zones from other zones. Reversing valves are sometimes utilized in the service assembly to prevent flow through the service assemblies below ports that allow flow of the treatment fluid from the service string to the formation via the completion assembly. Such devices can inhibit or prevent collection of useful data from the annulus between the service string and the completion assembly. It is desirable to provide apparatus and methods to obtain such data when the reversing valve is closed during treatment operations.

The disclosure herein provides apparatus and methods that provide fluid communication between the formation and an annulus between the service assembly and the completion assembly to obtain data at the surface from the annulus during treatment operations, including pressure testing of zones.

SUMMARY

An apparatus for use in a wellbore is disclosed that in one non-limiting embodiment includes an outer assembly for placement in a wellbore, the outer assembly including a set down profile, a first flow device, such as a sleeve valve, for supplying a fluid to a zone in the wellbore and a second flow device for providing a flow path from the formation to inside of the outer assembly. An inner assembly for placement inside the outer assembly is provided that includes a port for supplying a fluid from the inner assembly to the first flow device, a valve below the frac port that remains closed when a fluid at a selected flow rate flows downward from above the valve, and a bypass device uphole of the valve that opens when the inner assembly is set down in the set down profile to provide a flow path from the formation to an annulus between the inner assembly and the outer assembly above the frac port.

In another aspect, a method of completing a wellbore is disclosed that in one non-limiting embodiment includes: placing an outer assembly in the wellbore that includes a first flow device for supplying a fluid to a zone in the wellbore and a second flow device for providing a flow path from the zone to inside of the outer assembly; and placing an inner assembly inside the outer assembly that includes a frac port and a bypass device below the frac port that opens to provide an flow path or opening in the inner string when the bypass device is set in the outer string; setting the bypass device in the outer assembly to provide the opening in the inner string below the frac port; isolating the zone; and opening the first flow device and the second flow device to establish a flow path from the zone to an annulus between the inner assembly and the outer assembly via the opening in the inner string to perform a treatment operation.

Examples of the more important features of completion system have been summarized rather broadly in order that the detailed description thereof that follows may be better understood, and in order that the contributions to the art may be appreciated. There are, of course, additional features that will be described hereinafter and which will form the subject of the claims.

BRIEF DESCRIPTION OF THE DRAWINGS

For a detailed understanding of the apparatus and methods disclosed herein, reference should be made to the accompanying drawings and the detailed description thereof, wherein like elements are generally given same numerals and wherein.

DETAILED DESCRIPTION OF THE DRAWINGS

Figure 1A:
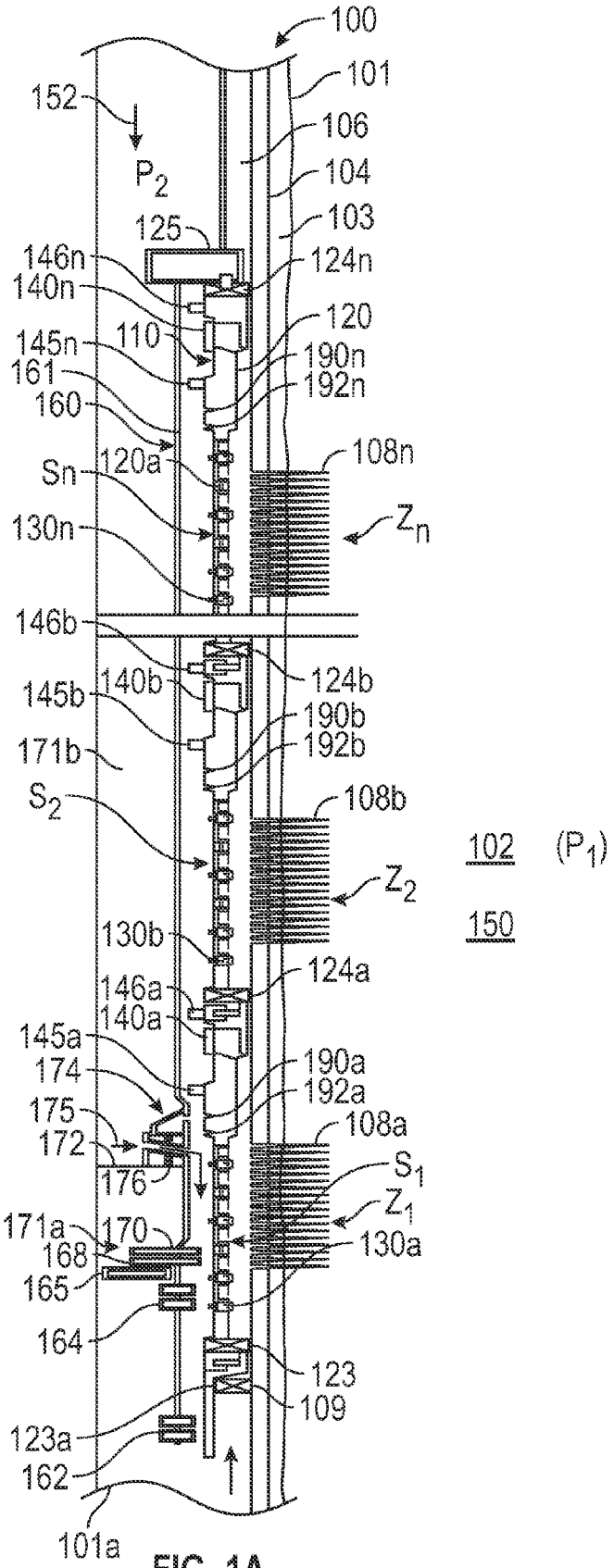
FIG. 1A shows an exemplary multi-zone wellbore system that includes a multi-zone outer string (completion assembly) and an inner string (service assembly) inside the outer string, wherein the inner string includes a bypass device for establishing fluid communication between the surface and the formation during a pressure test or treatment operation, according to one non-limiting embodiment of the present disclosure.

FIG. 1A is a line diagram of a section of a multi-zone wellbore system 100 that includes a wellbore 101 formed in formation 102 for performing a treatment operation, including pressure testing zones, fracturing and sand packing zones, gravel packing, flooding, etc. The wellbore 101 is lined with a casing 104, such as a string of jointed metal pipes sections. The space or annulus 103 between the casing 104 and the wellbore 101 is filled with cement 106. The formation 102 is shown to include multiple zones Z1-Zn for treatment and for the production of hydrocarbons therefrom. In FIG. 1, Zone Z1 is shown to include perforations 108*a*, Zone Z2 perforations 108*b*, and Zone Zn perforations 108*n*. The perforations provide fluid passages for fracturing of and for the production of fluids 150 from their respective zones. The wellbore 101 includes a sump packer 109 proximate to the bottom 101*a*.

Still referring to FIG. 1A, the wellbore contains a fluid 152, such as completion fluid, which fluid provides hydrostatic pressure (P2) inside the wellbore 101 greater than the formation pressure P1. To treat zones Z1-Zn, a system assembly 110 is run inside the casing 104. The system assembly 110 includes an outer string 120 (also referred to herein as the completion assembly) and an inner string 160

(also referred to herein as the service string or service assembly) placed inside the outer string 120. The outer string 120 includes a number of devices associated with each of the zone Z1-Zn for performing pressure tests on each zone and for treatment operations of such zones. In one non-limiting embodiment, the outer string 120 includes a lower packer 123 outside and proximate to bottom end 123*a* of the outer string 120. The outer string 120 further includes an isolation packer corresponding to each zone. For example, packer 124*a* corresponds with zone Z1, packer 124*b* with zone Z2 and packer 124*n* with zone Zn. The lower packer 123 isolates the sump packer 109 from hydraulic pressure exerted in the outer string 120 during fracturing and sand packing of the production zones Z1-Zn. The lower packer 123 may be utilized as the sump packer 109. When packer 124*a* is set, it isolates zone Z1 from the zones above zone Z1, when packer 124*b* is set, it isolates zone Z2 from the zones above it and so forth. The packers 124*a*-124*n* may be set or activated independently or at the same or substantially the same time and may be set hydraulically, mechanically or by any other suitable mechanism.

Still referring to FIG. 1A, the outer string 120 further includes a sand screen corresponding to each zone. For example, sand screen S1 below packer 124*a* and across from zone Z1, sand screen S2 below packer 124*b* and across from zone Z2 and sand screen Sn below packer 124*n* and across from zone Zn. The lower packer 123 and isolation packer 124*a*, when set, isolate zone Z1 from the remaining zones: packers 124*a* and 124*b* isolate zone Z2 and packers 124*n*-1 and 124*n* isolate zone Zn. Each of the sand screens S1-Sn may be made by serially connecting two or more screen sections with connection members to form the sand of a desired length, wherein the connections provide axial fluid communication between the adjacent screen sections. The outer string 120 also includes, for each zone, a flow control device, referred to as a slurry outlet or a gravel exit, such as a sleeve valve or another valve, between its corresponding packer and the screen to provide fluid communication between the inside 120*a* of the outer string 120 and its associated zone. As shown in FIG. 1A, a sleeve valve 140*a* is provided for zone Z1 between packer 124*a* and screen S1, sleeve valve 140*b* for zone Z2 and sleeve valve 140*n* for zone Zn. In FIG. 1A, the inner string 160 and outer string 120 are shown in the run-in position. The outer string 120 is further shown to include a flow device, also referred to as a monitoring valve, which may be a sleeve valve, for each zone to provide fluid communication between its corresponding zone and inside 120*a* of the outer string. In FIG. 1A, monitoring valves 130*a*-130*n* respectively are provided below screens S1-Sn for zones Z1-Zn. In FIG. 1, the inner string 160 and the outer string 120 are shown in the run in position (i.e., when the strings are moved into the wellbore) and in such a case flow devices 140*a*-140*n* and 130*a*-130*n* are typically in their closed positions, as shown in FIG. 1A so no fluid flows from the inside 120*a* of the outer string 120 to any of the zones Z2-Zn, until such devices are opened downhole.

Still referring to FIG. 1A, the outer string 120 may further include a seal below and another above each of the sleeve valves 140*a*-140*n* to seal an area around the sleeve valves 140-140*n* for performing treatment operations. In FIG. 1A, inverted seals 145*a* and 146*b* are shown associated with sleeve valve 140*a*, inverted seals 145*b* and 146*b* with the slurry outlet 140*b* and inverted seals 145*n* and 146*b* with slurry outlet 140*n*. In one aspect, the inverted seals may be configured so that they can be pushed inside the outer assembly 120 or removed from the inside of the outer string 120 after completion of the treatment operations or during the deployment of a production string (not shown) for the production of hydrocarbons from well bore 101. Any other seals may also be utilized. In one non-limiting embodiment, the outer string 120 also includes a zone indicating profile or locating profile for each zone: profile 190*a* for zone Z1, profile 190*b* for zone Z2 and profile 190*n* for zone Zn) and a corresponding set down profile: profile 192*a* for zone Z1, profile 192*b* for zone Z2 and profile 192*n* for zone Zn.

Still referring to FIG. 1A, the inner string 160 includes a tubular member or pipe 161 that in one embodiment includes a packer 125 and an opening shifting tool 162 to open the sleeve valves and other devices and a closing shifting tool 164 to close such devices. The inner string 160 further includes a reversing valve 165 that enables the removal of treatment fluid from the wellbore after treating each zone. The inner string 160 further includes an up-strain locating tool 168 and a set down tool 170. The up-strain locating tool 168 is configured to locate the locating profiles 192*a*-192*n* and the set down tool 170 is configured to be set down at each of the set down profiles 190*a*-190*n*. The inner string 160 further includes a plug 172 above the set down locating tool 170, which prevents fluid communication between the space 171*a* above the plug 172 and the space 171*b* below the plug 172. The inner string 160 further includes a crossover tool 174 (also referred to herein as the "frac port") for providing a fluid path 175 from the inner string 160 to the outer string 120. In one aspect, the frac port 174 also includes flow passages 176, which passages may be gun-drilled through the frac port 174 to provide fluid communication between space 171*a* and annulus A1 between the inner string 160 and the outer string 120. In one embodiment, the passages 176 are sufficiently narrow so that that there is a relatively small amount of fluid 106*d* flow through such passages. The passages 176, however, are sufficient to provide fluid flow and thus pressure communication between space 171*a* and annulus A1. In one embodiment, the reversing valve 165 is normally closed and remains closed when a fluid flows downward at or above a selected flow rate, which flow rate may be relatively low, such as one barrel per minute. However, the reversing valve 165 opens when the fluid flows upwards, i.e. toward the surface. Thus, when the inner string 160 is run into the wellbore, the reversing valve 165 remains open and when the inner string is stationary or moved upward, the reversing valve 165 is closed. During treatment, no fluid flows through such reversing valve and is thus closed. The reversing valve may open when treatment fluid supply is stopped and there is a fluid loss to the formation via a valve in the outer string. A reversing valve of the type described herein is disclosed in U.S. patent application Ser. No. 14/028,060, filed on Sep. 16, 2013 and assigned to the assignee of this application, which application is incorporated herein in entirety by reference. For ease of explanation and not as any limitation, a particular reversing valve is described herein. However, for the purpose of this disclosure any reversing valve that performs the intended functions may be utilized.

Figure 1B:
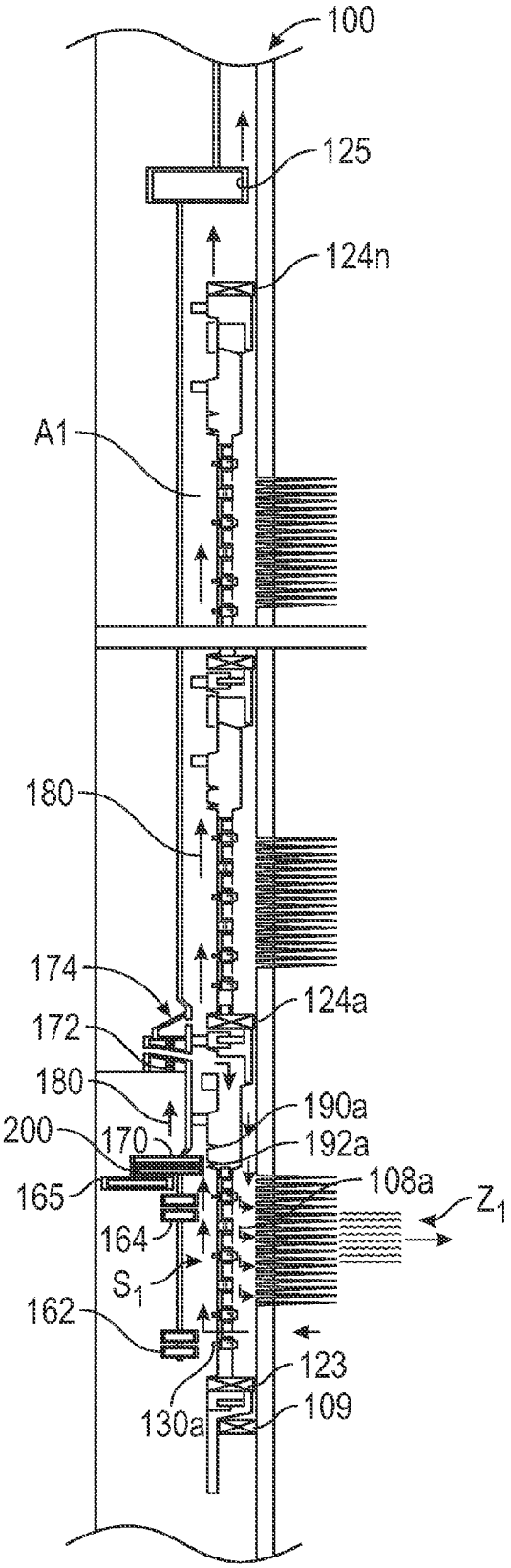
FIG. 1B shows the wellbore system of FIG. 1A, wherein the outer string and the inner string have been set to provide a fluid communication between the surface and the formation via the bypass device and to perform pressure tests and treatment operations of a selected zone.

Referring to FIGS. 1A and 1B, to perform a pressure test or a treatment of a particular zone, for example zone Z1, the outer string is stabbed into the sump packer 109 and the lower packer 123 and upper packer 124*n* are set. Setting the upper packer 124*n* and lower packer 123 anchors the outer string 120 inside the casing 104. The production zone Z1 is then isolated from all the other zones. The inner string 160 is manipulated so as to cause the opening tool 164 to open the monitoring valve 130*a* and the frac sleeve 140*a*. The inner string 160 is then manipulated (moved up and/or down) inside the outer string 120 so that the up-strain locating tool 168 locates the locating or indicating profile 190*a*. The set down tool 170 is then manipulated to cause it to set down in the set down profile 190*a*. When the set down tool 170 is set down in set down profile 192*a*, the frac port 174 aligns with the slurry outlet 140*a*. The pipe 161 of the inner string 160 has a sealing section that comes in contact with the inverted seals 145*a* and 146*a*, thereby isolating or sealing section 167 between the seals 145*a* and 145*b* while providing fluid communication between the inner string frac port 174 and the slurry outlet 140*a*. Once the packer 124*a* has been set, frac sleeve 140*a* is opened, as shown in FIG. 1B, and fluid 152 is pumped under pressure to zone Z1 to perform a pressure test and/or another treatment operation.

When a pressure test is performed, the fluid 152 supplied under pressure from the inner string 160 enters zone Z1 via the frac port 174 and frac sleeve 140*a*, while the reversing valve 165 and the monitoring valve 140*a* remain open. The reversing valve is open because no fluid passes therethrough (top to bottom) during treatment but may close after pumping of the fluid 152 has stops and the annulus starts to lose fluid to the zone Z1 through the monitoring valve 140*a*. After a selected time period, the fluid supply is stopped and the pressure downhole is monitored at the surface via annulus A1. To provide a pressure communication between the zone Z1 and the surface via annulus A1, a bypass device 200 (which may be part of the set down tool 170) is provided in the set down tool 170 that is normally closed unless the set down tool 170 is positioned in a set down profile, such as profile 192*a* in the case of zone Z1. When the bypass device 200 is open in the set down tool 170, it provides a flow path from zone Z1 to the annulus A1 via the monitoring valve 140*a*, bypass device 200 in set down tool 170 and the passages 176 in the frac port 174, as shown by arrows 180, enabling obtaining of pressure measurements at the surface of zone Z1 via the annulus A1. Although the bypass device 200 is described as being part of the set down tool 170, such a device may be an independent device placed between the device 172 and the reversing valve 165. Once zone Z1 has been pressure tested and treated, the treatment fluid in the wellbore is removed by supplying a fluid into the annulus A1, which returns to the surface via the inner string 160. A non-limiting embodiment of a bypass device for use in a completion system, including but not limited to, the system described herein is described below in reference to FIGS. 2A and 2B.

Figure 2A:
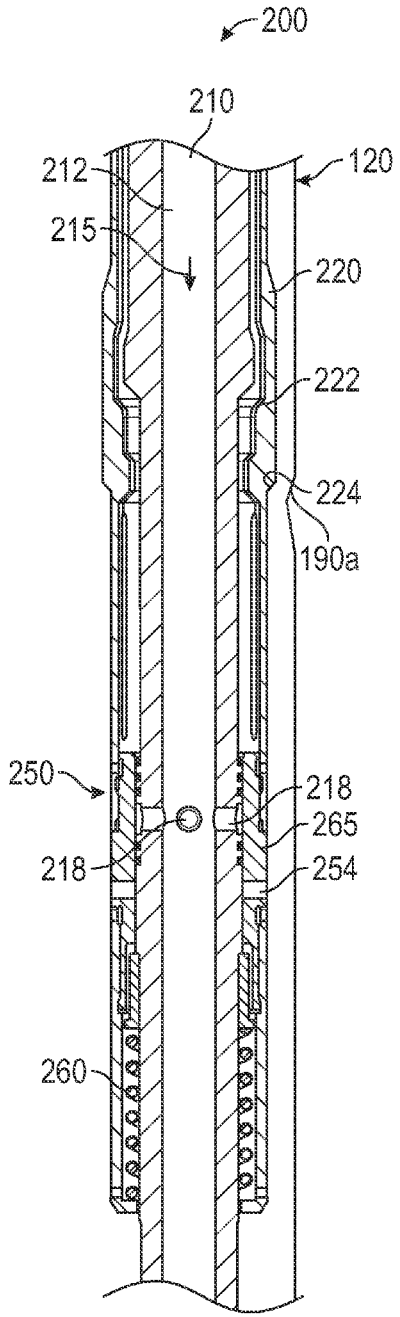
FIG. 2A shows a non-limiting embodiment of a bypass device in the open position for use in the inner string of FIG. 1A, according to one embodiment of the disclosure.

FIG. 2A show a non-limiting embodiment of a bypass device 200 (also referred to herein as "bypass valve") in its normal closed position that may be utilized in any suitable service assembly, such as the inner sting 160 shown in a FIG. 1A. In one embodiment, the bypass device 200 includes a mandrel 210 with an axial flow through path 212 that allows a fluid 215 to flow through the mandrel and lateral flow through paths or holes 218, which when open establish fluid communication with the outer string 120. The mandrel further includes an outer profile 214. The bypass device 200 further includes a collet 220 (also referred to herein as the set down collet) outside the mandrel 210 that includes an inner profile 222 and an outer profile 224. The mandrel 210 is selectively movable inside the collet 220. As described in reference to FIG. 1A, as the inner string 160 moves in the outer assembly 120 the bypass device 200 moves in the outer assembly 120. In one embodiment, the set down profiles 192*a*-192*n* in the outer string (FIG. 1A) are compatible with the outer profile 224 of the collet 220. The bypass device 200 also includes a valve body 252 that further includes lateral or radial flow passages or holes 254. The valve body 252 includes seals 260*a* above 218 and seals 260*b* below holes 218 around a sleeve 265. In the closed position, as shown in FIG. 2A, the seals 260*a* and 260*b* seal areas above and below the holes 218 and thus prevent flow of any fluid through holes 218. In this state, the bypass valve 200 is close or in the closed position. A spring 270 placed against the sleeve 265 maintains the seals 260*a* and 260*b* about the holes 218, i.e., it maintains the bypass device in the closed position.

Figure 2B:
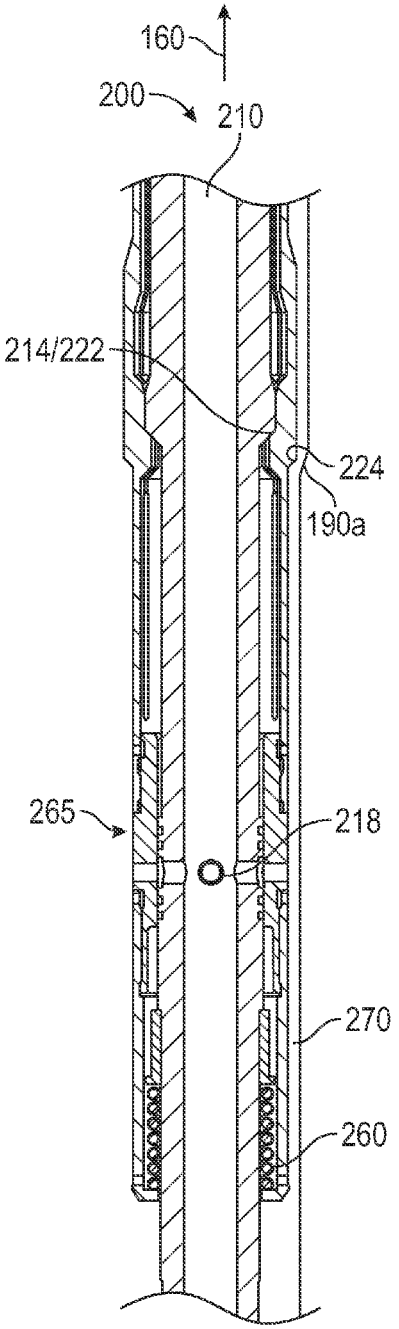
FIG. 2B shows the bypass device of FIG. 2A in the closed position when the inner string is positioned in the outer sting to perform a treatment operation.

Referring now to FIGS. 2A and 2B, when the inner string 160 is moved to the treatment position (FIG. 1B), the outer profile 224 of the collet 220 seats on a set down profile in the outer string 120, such as profiles 192*a*-192*n*, in the outer string 120, which prevents the collet 220 from moving further down in the outer string 120. However, the mandrel 210 moves downward due to the weight of the inner string 120 and causes the outer profile 214 on the mandrel 210 to seat on the inner profile 222 of the of collet 220, as shown in FIG. 2B. When the mandrel 210 moves downward, the sleeve 265 and thus the seals 260*a* and 260*b* move downward, exposing the holes 218 in the mandrel and aligning the passages 254 in the valve body 252 with the holes 218, thereby establishing a flow path between the mandrel 210 and the annulus 270 between the inner string 160 and the outer string 120. Moving the mandrel 210 downward causes the mandrel body 252 to push the biasing member, which may be a spring 260, from its uncompressed or neutral position shown in FIG. 2A to the compressed position shown in FIG. 2B. The weight of the inner string 160 keeps the flow communication between the annulus 270 and the inner string open as long as the bypass device 200 is set down in the outer string 120. Thus, during a treatment operation, the bypass device is open to provide fluid communication between the inner string 160 and the outer string 120 above the reversing valve 165 shown in FIGS. 1A and 1B. For example, during the treatment of a particular zone, for instance zone Z1, the bypass valve 200 will remain closed when the inner string 160 is manipulated into the outer string 120 to perform a variety of operations, such as setting packers, opening sleeve valve 140*a*, etc. and will open when the bypass device is seated at a particular profile in the outer string 120, such as profile 192*a*, at which position the frac port 150 is also aligned with the frac sleeve 140*a* so that a mini frac or other test may be performed and data, such as pressure changes over time, may be recorded through the annulus between the inner string 160 and the outer assembly 120. When the inner string 160 is moved away from the set down profiles 192*a*-192*n* (FIG. 1), the spring 260 acts on the sleeve 265 and moves the seals 260*a* and 260*b* to their initial positions, as shown in FIG. 2A, thereby closing the holes 218 and thus the bypass device 200.

The foregoing disclosure is directed to the certain exemplary embodiments and methods. Various modifications will be apparent to those skilled in the art. It is intended that all such modifications within the scope of the appended claims be embraced by the foregoing disclosure. The words "comprising" and "comprises" as used in the claims are to be interpreted to mean "including but not limited to". Also, the abstract is not to be used to limit the scope of the claims.

The invention claimed is:

1. An apparatus for use in a wellbore, comprising:

an outer assembly for placement in the wellbore, the outer assembly including a set down profile, a first flow device for supplying a fluid to a zone in the wellbore and a second flow device for providing a flow path from the zone to inside of the outer assembly; and an inner assembly for placement inside the outer assembly, the inner assembly including:

a frac port for supplying a fluid from the inner assembly to the first flow device, and a bypass device downhole of the frac port, wherein the bypass device opens when the inner assembly is set down in the set down profile and provides a flow path from below the frac port to an annulus between the inner assembly and the outer assembly above the frac port.

2. The apparatus of claim 1, wherein the bypass device includes an outer profile that engages with the set down profile of the outer string assembly to set down the bypass device inside the outer assembly.

3. The apparatus of claim 2, wherein the bypass device opens from a closed position when the bypass device is set in the set down profile.

4. The apparatus of claim 3, wherein the bypass device opens only when the bypass device is set in the set down profile.

5. The apparatus of claim 1, wherein the bypass device includes a movable sleeve over a port in the inner assembly and wherein the movable sleeve moves to open the port when the bypass device is set in the set down profile in the outer assembly.

6. The apparatus of claim 5, wherein:

the inner assembly includes a mandrel having a port; and the bypass device includes:

a collet having an outer profile that engages with the set down profile in the outer assembly to cause the bypass device to set down in the outer assembly; and a sleeve over the port and wherein the mandrel moves when the bypass device is set in the outer assembly to open the port to establish fluid communication between the second flow and the annulus.

7. The apparatus of claim 5, wherein the bypass device includes a force application device against the sleeve to keep the port in the inner assembly closed until the bypass device is set down in the set down profile in the outer assembly.

8. The apparatus of claim 1, further comprising a packer and a sand screen and wherein the first flow device is between the packer and the sand screen.

9. The apparatus of claim 1, wherein the frac port aligns with the first flow device when the bypass device is set in the set down profile.

10. The apparatus of claim 9, wherein one of the inner assembly and the outer assembly includes a first seal above the first flow device and a second seal below the first flow device to isolate an annulus between the inner assembly and the outer assembly about the first flow device when the bypass device is set in the set down profile in the outer assembly.

11. A method of completing a wellbore, comprising:

placing an outer assembly in the wellbore that includes a first flow device for supplying a fluid to a zone in the wellbore and a second flow device for providing a flow path from the zone to inside of the outer assembly;

placing an inner assembly inside the outer assembly, the inner assembly including a frac port and a bypass device below the frac port that opens to provide an opening in the inner string assembly when the bypass device is set in the outer assembly;

setting the bypass device in the outer assembly to provide the opening in the inner assembly below the frac port;

isolating the zone; and opening the first flow device and the second flow device to establish a flow path from the zone to an annulus between the inner assembly and the outer assembly above the frac port via the opening in the inner string assembly to perform a treatment operation.

12. The method of claim 11, wherein the treatment operation includes supplying a fluid under pressure to the zone via the frac port and the first flow device.

13. The method of claim 12, further comprising:

stopping supply of the fluid after a selected time period; and monitoring pressure of the zone from the annulus.

14. The method of claim 13, further comprising determining an inflection point from the monitored pressure.

15. The method of claim 11, wherein the outer assembly includes a set down profile and the bypass device includes an outer profile configured to set down in the set down profile, wherein the bypass device opens only when the outer profile of the bypass device is set in the set down profile in the outer assembly.

16. The method of claim 11, further comprises a reversing valve below the bypass device that remains open during the treatment operation to prevent flow of fluid from the zone to the annulus.

17. The method of claim 11, wherein the bypass device includes a movable sleeve over a port in the inner assembly that moves to open the port when the bypass device is set in the set down profile in the outer assembly.

18. The method of claim 17, wherein:

the inner assembly includes a mandrel having a port; and the bypass device includes:

a collet having an outer profile that engages with the set down profile in the outer assembly to cause the bypass device to set down in the outer assembly; and a sleeve over the port and wherein the mandrel moves when the bypass device is set down in the outer set down profile in the outer assembly to open the port to establish fluid communication between the inner assembly and the outer assembly.

19. The method of claim 18, wherein the bypass device includes a force application device against the sleeve to keep the port in the inner assembly closed until the bypass device is set down in the set down profile in the outer assembly.

20. The method of claim 11, further comprising a packer and a sand screen and wherein the first flow device is between the packer and the sand screen and wherein the frac port aligns with the first flow device when the bypass device is set in the set down profile.

21. The method of claim 20, wherein one of the inner assembly and the outer assembly includes a first seal above the first flow device and a second seal below the first flow device to isolate an annulus between the inner assembly and the outer assembly about the first flow device when the bypass device is set in the set down profile in the outer assembly.

* * * * *